US009279349B2

(12) United States Patent
Hutchinson

(10) Patent No.: US 9,279,349 B2
(45) Date of Patent: Mar. 8, 2016

(54) LUBRICANT DELIVERY SYSTEM FOR INTERNAL COMBUSTION ENGINES

(75) Inventor: Frank Hutchinson, West Melbourne (AU)

(73) Assignee: FLASHLUBE PTY LTD, West Melbourne, Victoria (AU)

( * ) Notice: Subject to any disclaimer, the term of this patent is extended or adjusted under 35 U.S.C. 154(b) by 205 days.

(21) Appl. No.: 12/866,731

(22) PCT Filed: Feb. 9, 2009

(86) PCT No.: PCT/AU2009/000148

§ 371 (c)(1), (2), (4) Date: Dec. 13, 2010

(87) PCT Pub. No.: WO2009/097664

PCT Pub. Date: Aug. 13, 2009

(65) Prior Publication Data

US 2011/0083634 A1 Apr. 14, 2011

(30) Foreign Application Priority Data

Feb. 8, 2008 (AU) ..... 2008900598

(51) Int. Cl.

| | |
|---|---|
| ***F01M 1/02*** | (2006.01) |
| ***F01M 3/00*** | (2006.01) |
| ***F01M 1/00*** | (2006.01) |
| ***F01M 9/00*** | (2006.01) |
| ***F01L 3/24*** | (2006.01) |

(Continued)

(52) U.S. Cl.

CPC ..... *F01L 3/24* (2013.01); *F01L 2810/02* (2013.01); *F01M 3/02* (2013.01); *F02B 61/045* (2013.01); *F02B 2075/025* (2013.01)

(58) Field of Classification Search

CPC ..... F01M 11/02; F01M 3/02; F01M 1/02; F02B 2075/027; F02B 2075/025; F02B 61/045; F16N 13/18; F16N 13/04; F16N 13/20

USPC ..... 123/196 R

See application file for complete search history.

(56) References Cited

U.S. PATENT DOCUMENTS 3,489,316 A * 1/1970 Velvin, Jr. ..... 222/19
3,514,017 A * 5/1970 Malone ..... 222/321.7

(Continued)

FOREIGN PATENT DOCUMENTS

DE 195 14 232 A1 10/1996
DE 296 23 670 U1 5/1999

(Continued)

OTHER PUBLICATIONS

Supplementary European Search Report and European Search Opinion for European Application No. 09708506 dated Nov. 4, 2011.

(Continued)

*Primary Examiner* — Lindsay Low
*Assistant Examiner* — Syed O Hasan
(74) *Attorney, Agent, or Firm* — Nixon Peabody LLP

(57) ABSTRACT

A lubricant delivery system for an internal combustion engine is disclosed. The system includes a pump that draws lubricant from a lubricant reservoir and expels lubricant for delivery to the inlet manifold of the engine; and a pump controller that receives a signal that is representative of an engine operating condition. The controller controls the lubricant delivery rate of the pump based on the signal.

11 Claims, 5 Drawing Sheets

(51) Int. Cl.

| | |
|---|---|
| *F02B 61/04* | (2006.01) |
| *F02B 75/02* | (2006.01) |
| *F01M 3/02* | (2006.01) |

(56) References Cited

U.S. PATENT DOCUMENTS

| | | | | |
|---|---|---|---|---|
| 4,642,604 | A * | 2/1987 | Glesmann et al. | 340/451 |
| 4,745,896 | A | 5/1988 | Schultz | |
| 5,287,833 | A * | 2/1994 | Yashiro | 123/196 CP |
| 5,477,830 | A * | 12/1995 | Beck et al. | 123/470 |
| 5,903,215 | A * | 5/1999 | Kanno | 340/450.3 |
| 5,934,242 | A * | 8/1999 | Anamoto | 123/196 R |
| 5,941,745 | A | 8/1999 | Kanno | |
| 6,244,385 | B1 * | 6/2001 | Tsubata et al. | 184/6.4 |
| 6,253,137 | B1 * | 6/2001 | Abo et al. | 701/51 |
| 6,374,781 | B1 * | 4/2002 | Kato | 123/73 AD |
| 2003/0216093 | A1 | 11/2003 | Koerner et al. | |
| 2008/0314686 | A1 | 12/2008 | Romano et al. | |

FOREIGN PATENT DOCUMENTS

| | | | |
|---|---|---|---|
| EP | 0 777 077 | A1 | 6/1997 |
| FR | 868 123 | | 12/1941 |
| FR | 868 123 | A | 12/1941 |
| GB | 2 304 813 | | 3/1997 |
| GB | 2 304 813 | A | 3/1997 |
| JP | 60-56114 | A | 4/1985 |
| JP | 60-056114 | A | 4/1985 |
| JP | 62-157202 | A | 7/1987 |
| JP | 62-157202 | A | 7/1987 |
| JP | 09-021677 | A | 1/1997 |
| JP | 9-21677 | A | 1/1997 |

OTHER PUBLICATIONS

"Electronic Valve Protector" (Seite 1 bis 8) mit CE-Konformitatserklarung vom 11. Jan. 2008.

* cited by examiner

LUBRICANT DELIVERY SYSTEM FOR INTERNAL COMBUSTION ENGINES

CROSS REFERENCE TO RELATED APPLICATIONS

This application is a national phase of International Application No. PCT/AU2009/000148, entitled, "Lubricant Delivery System for Internal Combustion Engines", which was filed on Feb. 9, 2009, and which claims priority of Australian Patent Application No. 2008900598, filed Feb. 8, 2008.

FIELD OF THE INVENTION

The present invention relates to a lubricant delivery system for an internal combustion engine.

BACKGROUND

Valve seat recession occurs in internal combustion engines when hot valves (most commonly the exhaust valves) contact the valve seat in the engine head. The heat from the valve creates a localized "weld" between the valve and the valve seat. When the valve is re-opened, material from the valve seat breaks away because the valve seat is made of softer material than the valve. Thus, the valve seat progressively recesses into the cylinder head.

The occurrence of valve seat recession is exacerbated when the engine is operating at high loads, such as when the vehicle is towing a load. Such high load conditions result in higher engine operating temperatures. For this reason, some fuels include lubricants to act as a cushion between the valve and the valve seat, which minimizes the direct contact between the components and minimizes valve seat recession.

Vehicles that have been modified to run on Liquefied Petroleum Gas (LPG) or Compressed Natural Gas (CNG) are particularly susceptible to valve seat recession because these fuels are dry burning fuels. In addition, these fuels combust at higher temperatures than petrol.

It is known to provide a lubrication system to lubricate the upper cylinder region of the engine and thus minimize the occurrence of valve seat recession. Such known systems deliver a lubricant to the engine inlet manifold downstream of the throttle body. This allows the lubricant to mix with air/fuel mixture prior to being drawn into the cylinders.

The known systems utilize inlet manifold vacuum pressure to draw lubricant from the reservoir into the manifold. This system requires the delivery rate to be set manually by an empirical flow rate method. Furthermore, it can be difficult to set the delivery rate of lubricant to provide the required amount of lubricant across all engine operating conditions.

SUMMARY OF THE INVENTION

The present invention provides a lubricant delivery system for an internal combustion engine, the system comprising:

a pump that draws lubricant from a lubricant reservoir and expels lubricant for delivery to the inlet manifold of the engine; and a pump controller that receives a signal that is representative of an engine operating condition;

wherein the controller controls the lubricant delivery rate of the pump based on the signal.

In certain embodiments in which the system is fitted to a vehicle that has electronic fuel injection, the signal is representative of the duty cycle of the fuel injectors.

Preferably, the pump is controlled to expel lubricant at a rate that is within the range of 0.5 to 5 milliliters per liter of fuel consumed by the engine.

More preferably, the pump is controlled to expel lubricant at a rate of approximately 1 milliliter per liter of fuel consumed by the engine.

In certain alternative embodiments, the signal is representative of the engine rotational speed.

Alternatively or additionally, the signal is representative of any one or more of: the throttle position, spark ignition timing, and inlet manifold pressure.

Preferably, the pump is arranged to expel lubricant as a pulse of discrete volume, and the controller controls the frequency of pulses expelled by the pump.

The pump may include a piston that reciprocates within a cylinder to transfer lubricant from a pump inlet end to a pump outlet end. In such a pump, the piston can be moved in a first direction by an electrical current flowing through a coil that surrounds the cylinder, and moved in the opposing direction by a spring that acts on the piston.

In an alternative embodiment, the pump has a variable volumetric flow rate of lubricant delivered from the pump and the controller controls the flow rate of lubricant from the pump.

In one embodiment, the system further comprises a nozzle that receives lubricant from the pump and expels the lubricant as a mist.

Preferably, the number of cylinders of the engine can be pre-set in the controller, whereby the control of the pump is also based on the number of cylinders.

Preferably, the number of valves per cylinder of the engine can be pre-set in the controller, whereby the control of the pump is also based on the number of valves.

Preferably, the system further comprises a reservoir fluid level sensor that is operatively connected with the reservoir, and a warning indicator that indicates that fluid level within the reservoir is below a predetermined level.

Preferably, the warning indicator is an indicator lamp, such as a LED.

Preferably, the system further comprises a mounting bracket for mounting the lubricant reservoir to a vehicle.

Preferably, the pump and/or controller are mounted within a recess on the outer surface of the lubricant reservoir.

BRIEF DESCRIPTION OF THE DRAWINGS

In order that the invention may be more easily understood, embodiments will now be described, by way of example only, with reference to the accompanying drawings, in which.

DETAILED DESCRIPTION

Figure 1:
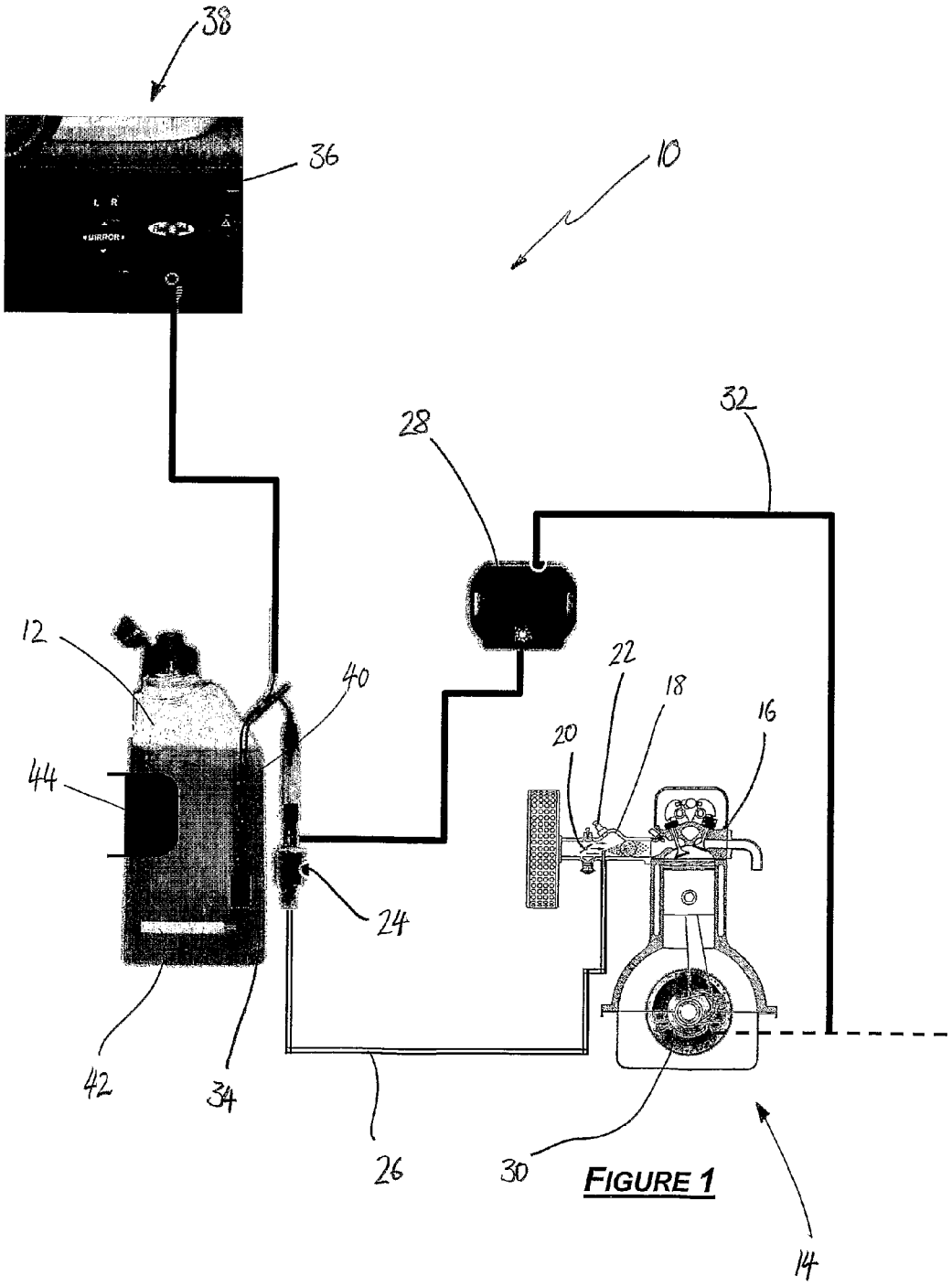
FIG. 1: is a schematic view of a lubricant delivery system according to a first embodiment of the present invention.

FIG. 1 shows schematically a lubricant delivery system 10 according to a first embodiment of the present invention. The lubricant delivery system 10 is arranged to deliver lubricant from a reservoir 12 to an engine 14. The lubricant is to be used to provide lubrication to the upper cylinder region of the engine 14. Thus, valve seat recession in the head 16 of the engine 14 can be prevented, or at least minimized.

The engine 14 has an electronic fuel injection system, the details of which are not directly relevant to the present invention. The engine 14 has an inlet manifold 18, which includes a throttle body 20 and fuel injectors 22.

The lubricant delivery system 10 has a pump 24 that draws lubricant from the reservoir 12 and expels the lubricant through a supply hose 26 for delivery to the inlet manifold 18. As shown in FIG. 1, the lubricant is delivered to the inlet manifold 18 downstream of the throttle body 20. This enables the lubricant to be mixed with air and fuel before being drawn into the cylinders.

The lubricant delivery system 10 also has a pump controller 28 for controlling the lubricant delivery rate of the pump 24. To this end, the controller 28 receives a signal that is representative of the engine operating condition. In this embodiment, the engine 14 has a timing wheel 30, which is connected to the engine crank shaft and which is used to provide engine rotational speed information to the engine management system (not shown). The timing wheel 30 operates with a sensor (not shown) to generate electronic pulses that are communicated to the engine management system. As indicated by the broken line in FIG. 1, the controller 28 is in electrical communication, via a conductive wire 32, with the engine management system such that the controller 28 receives engine rotational speed information.

The controller 28 uses the engine rotational speed information to select a lubricant delivery rate that is appropriate for the engine operating conditions. In particular, the controller 28 can use the engine rotational speed information to calculate the rate of fuel being consumed by the engine 14. The controller 28 then controls the pump 24 to deliver lubricant at an optimal rate.

In this embodiment, the pump 24 is arranged to deliver lubricant as a pulse of discrete volume to the inlet manifold 18. The controller 28 is in electronic communication with the pump 24 and controls the frequency of pulses expelled by the pump 24, thereby controlling the delivery rate of lubricant.

To more accurately calculate the current fuel consumption rate of the vehicle to which the system 10 is mounted, the controller 28 includes the ability to pre-set the number of cylinders in the engine. To this end, the controller 28 may have a switch (not shown) that pre-sets the controller 28 during installation. In addition, the controller 28 can include the ability to pre-set the number of valves per cylinder of the engine. The controller 28 may have another switch (also not shown) for pre-setting the controller 28 during installation.

The lubricant delivery system 10 also includes a fluid level sensor 34, which is disposed within the reservoir, and a warning indicator. In this embodiment, the warning indicator is in the form of a LED 36 that is mounted on an instrument panel 38 of the vehicle to which the lubricant delivery system 10 is mounted. When lubricant within the reservoir falls below a predetermined level (which is the height of the sensor), the LED 36 is illuminated to provide a warning to the vehicle operator that the lubricant level is low.

As shown in FIG. 1, the sensor 34 is located on a dip tube 40 that extends into the reservoir 12. One end of the dip tube 40 is connected to the pump 24, while the other end is connected to a filter 42.

The lubricant delivery system also includes a mounting bracket 44 for convenient mounting of the reservoir 12 within the engine bay of a vehicle.

While not shown in the Figures, the system 10 can also have a nozzle that receives lubricant from the supply hose 26. The nozzle expels the lubricant into the inlet manifold 18 as a mist that is readily mixed with the air/fuel mixture.

Tests have been performed of a known lubricant that is sold under the trade name Flashlube Valve Saver Fluid with engines operating on various fuels. This lubricant has a viscosity in the range of 15 to 20 centistokes. The tests have indicated that the optimal delivery rate of this lubricant is within the range of 0.5 to 5 milliliters of lubricant per liter of fuel consumed by the engine. In minimizing valve seat recession, the tests have shown that the optimal delivery rate of this lubricant is approximately 1 milliliter of lubricant per liter of fuel consumed by the engine.

Figure 2:
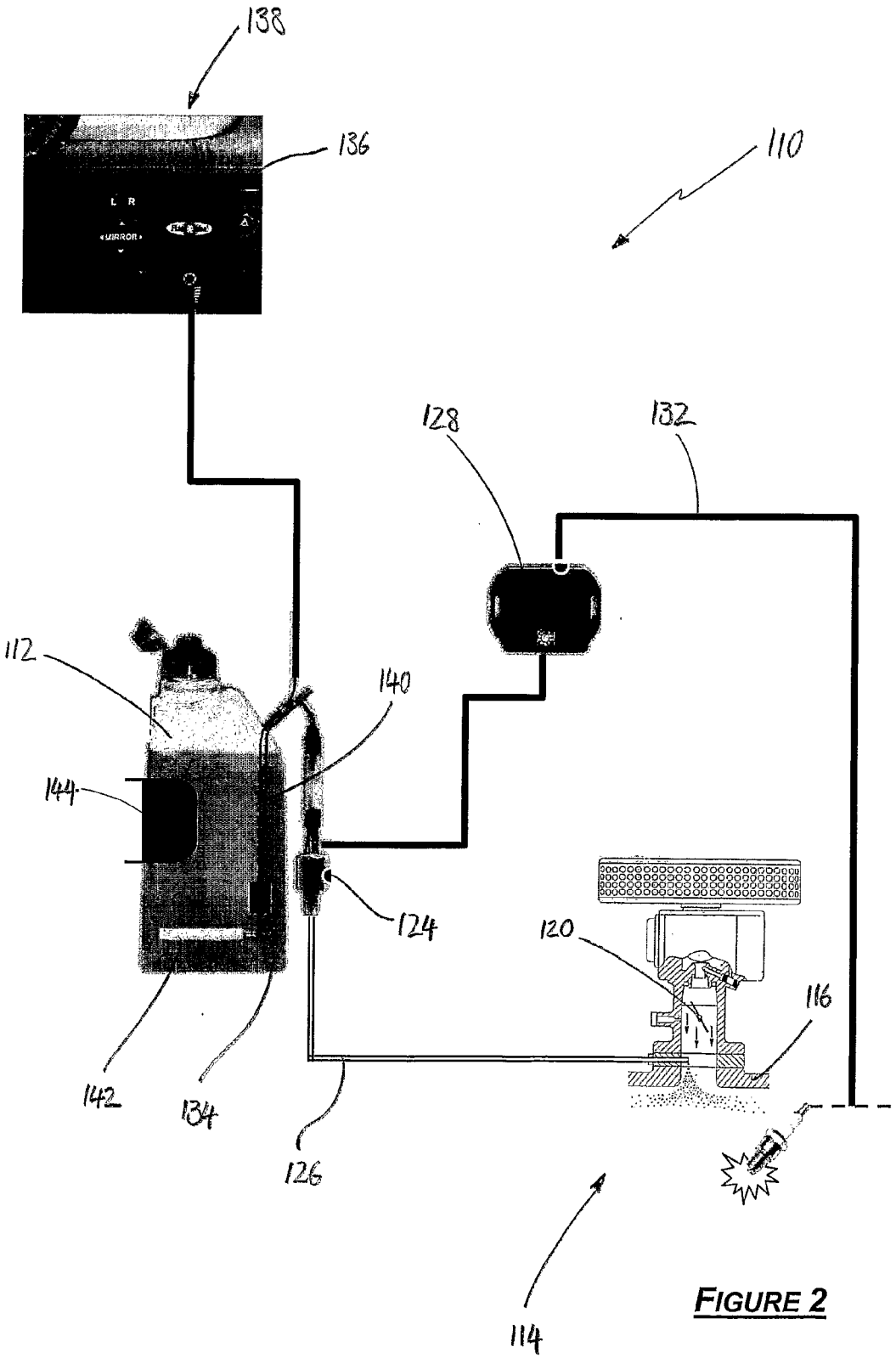
FIG. 2: is a schematic view of a lubricant delivery system according to a second embodiment of the present invention.

FIG. 2 shows schematically a lubricant delivery system 110 according to a second embodiment of the present invention. The lubricant delivery system 110 is similar to the lubricant delivery system 10 previously described. Accordingly, features of the lubricant delivery system 110 that are identical to that of the lubricant delivery system 10 have reference numerals incremented by 100.

The lubricant delivery system 110 is arranged to deliver lubricant to an engine 116 that uses a carburettor to mix fuel and air before being injected into the engine 116. As shown in FIG. 2, lubricant is delivered to the inlet manifold 118 downstream of the throttle body 120.

Most engines that have a carburettor do not have an engine rotational speed sensor. Accordingly, in this embodiment, the controller 128 of the lubricant delivery system 110 uses spark ignition timing to determine engine rotational speed, and thus calculate the rate of fuel being consumed by the engine 116. The spark ignition timing information can be obtained from the distributor of the engine 116, as indicated by the broken line in FIG. 2.

Figure 3:
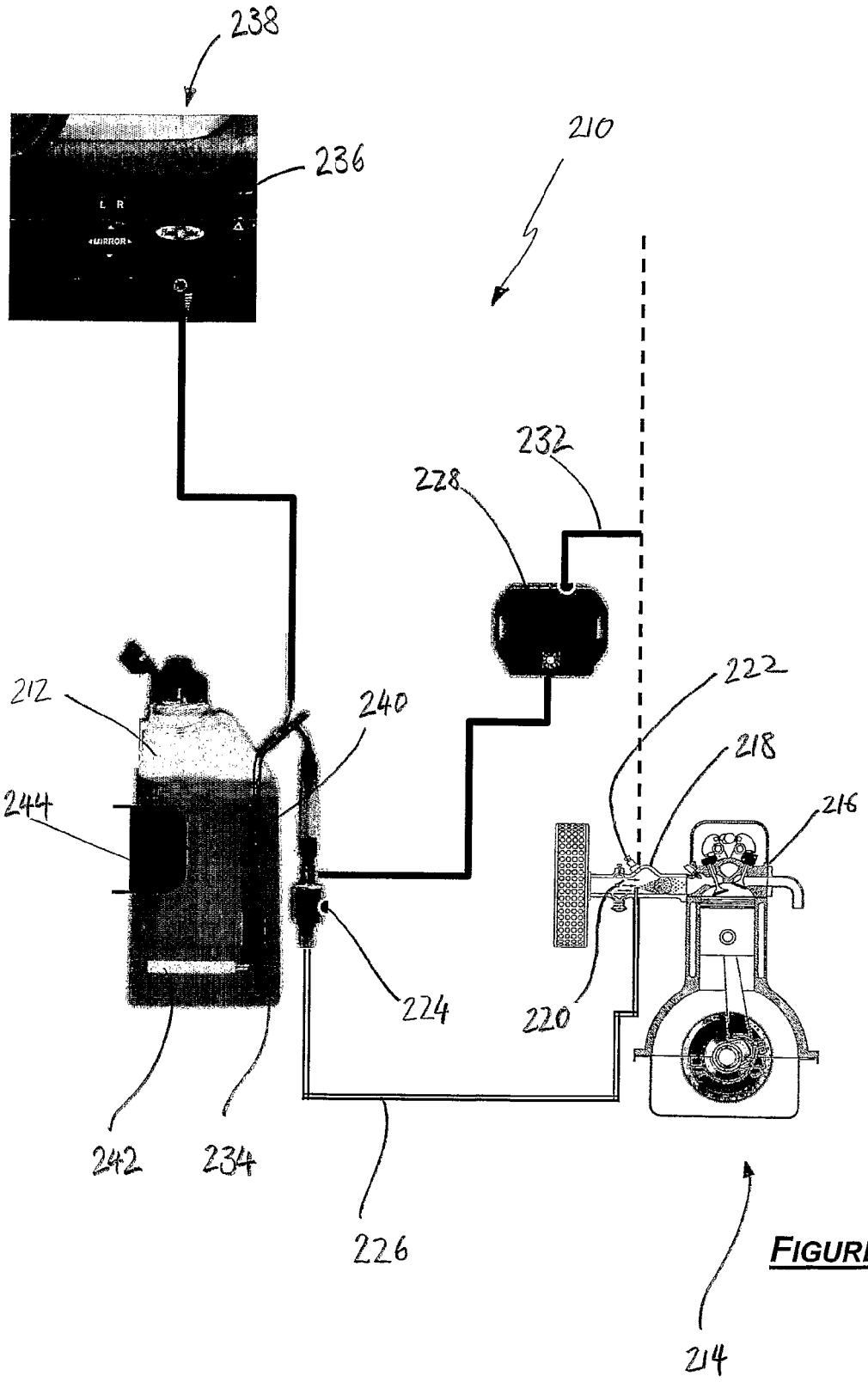
FIG. 3: is a schematic view of a lubricant delivery system according to a third embodiment of the present invention.

FIG. 3 shows schematically a lubricant delivery system 210 according to a second embodiment of the present invention. The lubricant delivery system 210 is similar to the lubricant delivery system 10 previously described. Accordingly, features of the lubricant delivery system 210 that are identical to that of the lubricant delivery system 10 have reference numerals incremented by 200.

The lubricant delivery system 210 also has a pump controller 228 for controlling the lubricant delivery rate of the pump 24. However, in this embodiment, the controller 228 receives a signal, such as an electronic signal, that is indicative of the injector duty cycle. As indicated by the broken line in FIG. 3, the controller 228 is in electrical communication, via a conductive wire 232, with the engine management system such that the controller 228 receives injector duty cycle information.

The injector duty cycle has the particular advantage of providing information simultaneously that is representative of both engine speed and fuel delivery rate for the fuel injectors. In particular, engine speed can be determined by the leading edge of the injector pulse. The fuel delivery rate can be determined by the injector pulse width, together with the number of injectors and the properties of each injector nozzle.

This information can be used to determine the instantaneous fuel consumption rate of the engine, which in turn enables particularly accurate determination of the lubricant delivery rate that is appropriate for the instantaneous engine operating conditions. Accordingly, when the vehicle is accelerating hard with both high engine speed and a high fuel flow rate, the lubricant delivery rate will be high. Conversely, when the vehicle is cruising at low speeds with both low engine speed and a low fuel flow rate, the lubricant delivery rate will be low. In other words, the lubricant delivery system 210 is capable of accurately delivering appropriate volumes of lubricant across all engine operating conditions.

Figure 4:
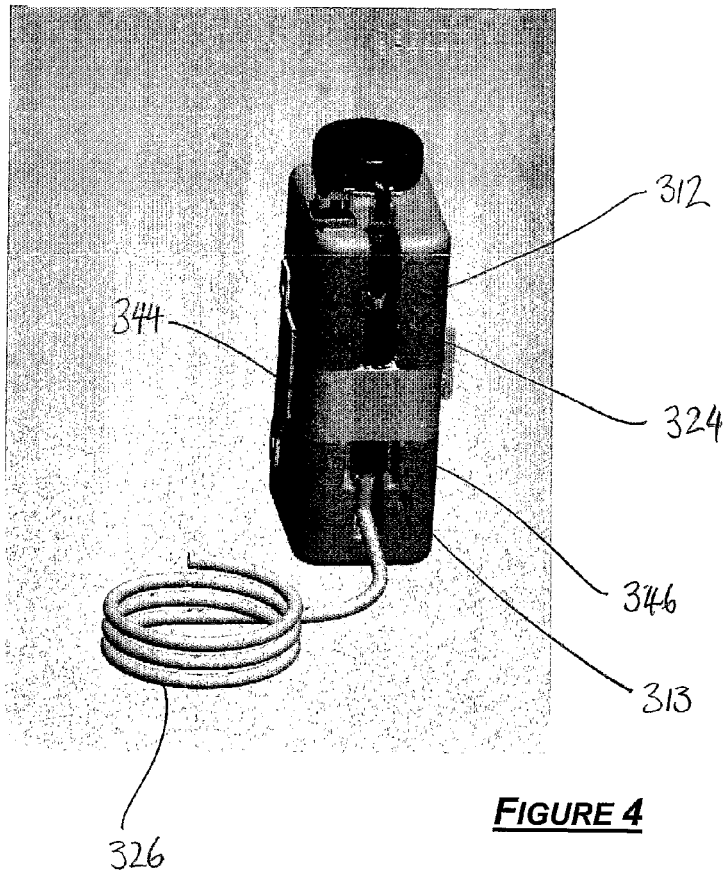
FIG. 4: is a perspective view of the reservoir and pump of a lubricant delivery system in accordance with a fourth embodiment of the present invention.
Figure 5:
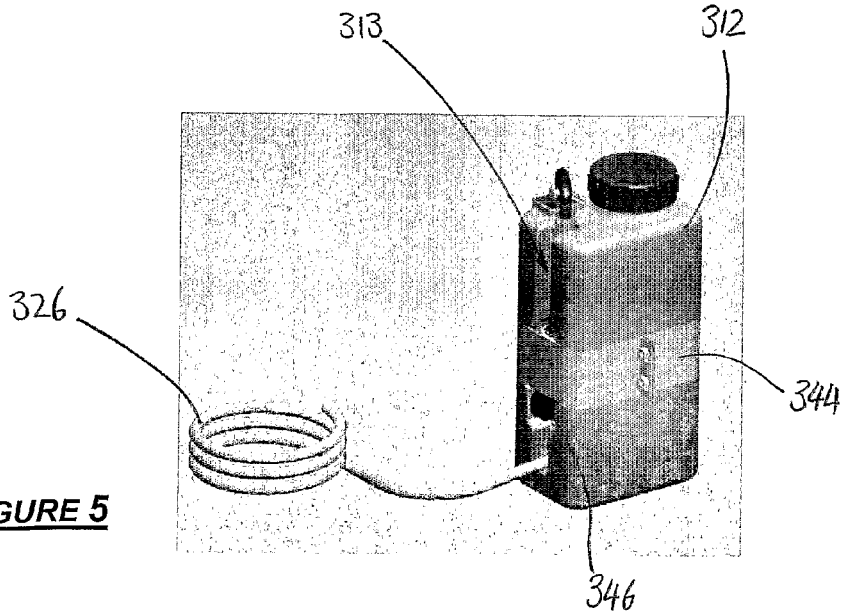
FIG. 5: is another perspective view of the reservoir and pump shown in FIG. 4.

FIGS. 4 and 5 show a reservoir 312, pump 324, and supply hose 326 of a lubricant delivery system 310 according to a fourth embodiment of the present invention.

A mounting bracket 344 is provided for convenient mounting of the reservoir 312 in the engine bay of a vehicle.

One side wall of the reservoir 312 includes a recess 313, within which the pump 324 is positioned. The bracket 344 restrains the pump 324 in the recess 313. In addition, the reservoir 312 and bracket 344 protect the pump 324 and controller 328 from damage.

The pump 324 includes an electrical connector 346 for connection to the pump controller of the lubricant delivery system.

Figure 6:
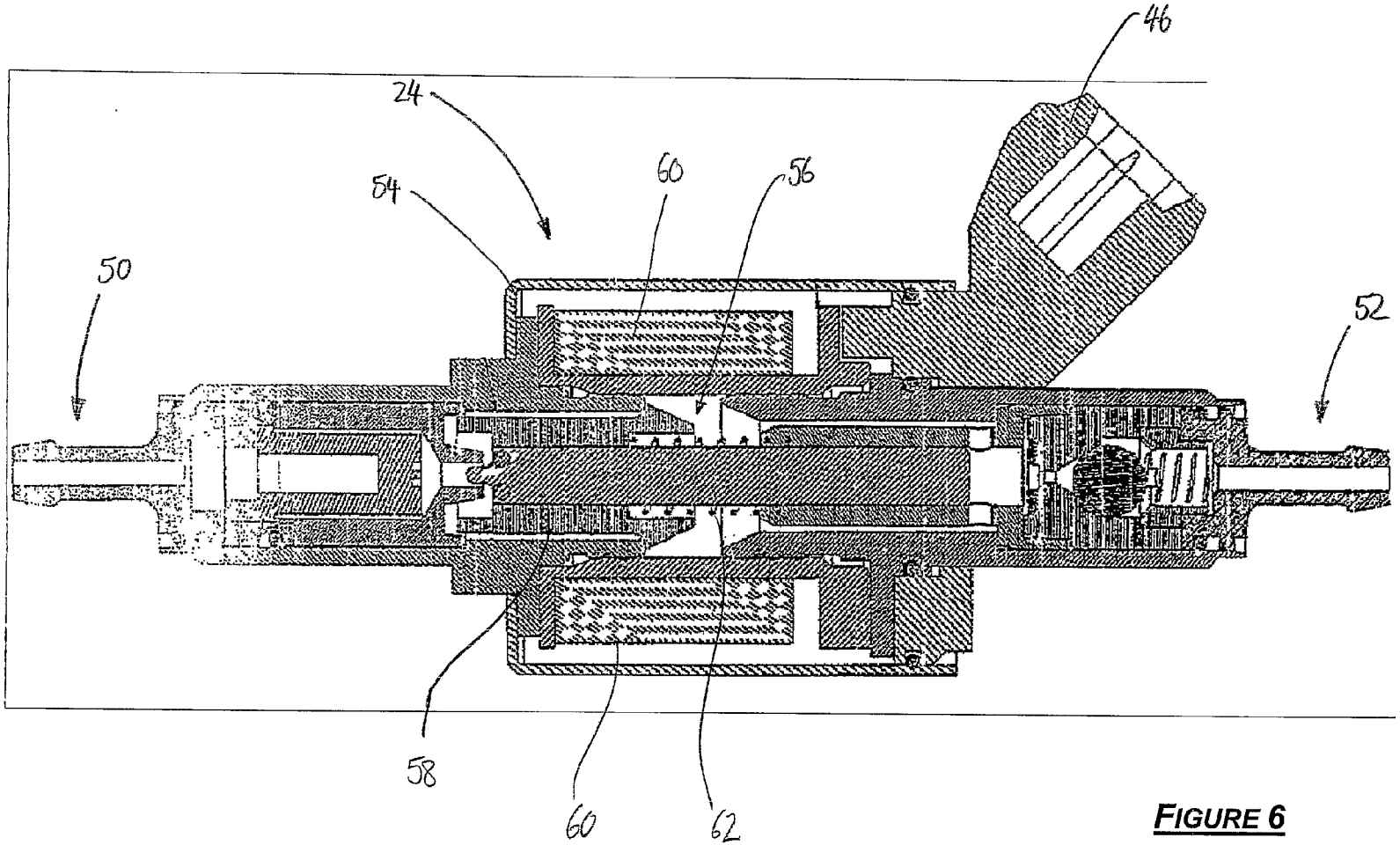
FIG. 6: is a schematic cross sectional view of the pump of lubricant delivery systems according to FIGS. 1 to 3.

FIG. 6 shows schematically the pump 24, 124, 224 of the lubrication delivery systems 10, 110, 210 of FIGS. 1 to 3. For simplicity, the pump 24, 124, 224 is hereinafter referred to as "pump 24". The pump 24 has an inlet end 50, which is to be connected to the dip tube, and an outlet end 52 that is connected to the supply hose.

The pump 24 has a pump body 54 within which a cylinder 56 is formed. A piston 58 is located inside the cylinder 56. In use, the piston 58 reciprocates within the cylinder 56 to draw lubricant in through the inlet 50, and expel lubricant through the outlet 52. The pump body 54 also contains a coil 60 of electrically conductive wires that extends around the cylinder 56.

When a voltage is applied to the coil 60, the induced magnetic field urges the piston 58 to move in a first direction. A spring 62 is provided within the cylinder 56 to move the piston 58 in the opposing direction when current ceases to flow through the coil 60. In this way, the coil 60 and piston 58 act as a solenoid.

In use of the pump 24, each time the piston 58 reciprocates within the cylinder 56, lubricant is expelled from the cylinder 56 through a one-way ball valve (not shown) and through the outlet end 52. In the same cycle, lubricant is drawn into the cylinder 56 through the inlet end 50. In this way, the pump 24 is immediately primed after lubricant has been expelled.

As will be appreciated, each reciprocation cycle of the piston 58 corresponds with a "pulse" of the pump 24. With each reciprocation cycle, a discrete volume of lubricant is expelled from the pump 24.

The pump 24 includes an electrical connector 46 that facilitates connection with the pump controller of the lubricant delivery system.

It will be understood to persons skilled in the art of the invention that many modifications may be made without departing from the spirit and scope of the invention.

For example, the signal that is provided to controller of the lubricant delivery system could be representative of throttle position or inlet manifold pressure. The controller may use two or more of the previously described signals to determine the current fuel consumption of the engine.

The operation of the pump may be controlled in any suitable manner to obtain the desired lubricant delivery rate. For example, the volumetric flow rate may be controlled by the controller.

The warning indicator that indicates that fluid level within the reservoir is below a predetermined level may alternatively or additionally include an audible alarm. The audible alarm may be arranged to operate only when the engine is running and the lubricant level is low. The audible alarm may sound for a single period, intermittently or continuously.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A lubricant delivery system for an internal combustion engine, the system comprising: a pump that draws lubricant from a lubricant reservoir and expels lubricant for delivery to an inlet manifold of the engine; and a pump controller that receives a signal that is representative of an engine operating condition, wherein the controller controls the lubricant delivery rate of the pump based on the signal, wherein the internal combustion engine has electronic fuel injection and the signal is representative of the duty cycle of fuel injectors, and the pump controller has a switch, the switch configured to pre-set an engine parameter during installation so that the controller accurately calculates the fuel consumption rate of the engine such that the lubricant delivery rate is an optimum flow rate for the engine.

2. A lubricant delivery system according to claim 1, wherein the pump is controlled to expel lubricant at a rate that is within the range of 0.5 to 5 milliliters per liter of fuel consumed by the engine.

3. A lubricant delivery system according to claim 1, wherein the pump is controlled to expel lubricant at a rate of approximately 1 milliliter per liter of fuel consumed by the engine.

4. A lubricant delivery system according to claim 1, wherein the pump is arranged to expel lubricant as a pulse of discrete volume, and the controller controls a frequency of pulses expelled by the pump.

5. A lubricant delivery system according to claim 1, wherein the pump includes a piston that reciprocates within a cylinder to transfer lubricant from a pump inlet end to a pump outlet end.

6. A lubricant delivery system according to claim 5, wherein the piston is moved in a first direction by a magnetic field induced by electrical current flowing through a coil that surrounds the cylinder, and moved in the opposing direction by a spring that acts on the piston.

7. A lubricant delivery system according to claim 1, further comprising a nozzle that receives lubricant from the pump and expels the lubricant as a mist.

8. A lubricant delivery system according to claim 1, wherein the number of cylinders of the engine can be pre-set in the controller, whereby the control of the pump is also based on the number of cylinders.

9. A lubricant delivery system according to claim 1, wherein the number of valves per cylinder of the engine can be pre-set in the controller, whereby the control of the pump is also based on the number of valves.

10. A lubricant delivery system according to claim 1, further comprising a reservoir fluid level sensor that is operatively connected with the reservoir, and a warning indicator that indicates when the fluid level within the reservoir is below a predetermined level.

11. A lubricant delivery system according to claim 1, wherein the pump is mounted within a recess on the outer surface of the lubricant reservoir.

* * * * *